United States Patent [19]

Conrad

[11] 4,312,289

[45] Jan. 26, 1982

[54] PERMANENT MOORING APPARATUS

[76] Inventor: Joseph Conrad, 3820 Warwick Blvd., Kansas City, Mo. 64111

[21] Appl. No.: 93,932

[22] Filed: Nov. 13, 1979

[51] Int. Cl.[3] ..... B63B 21/28

[52] U.S. Cl. ..... 114/295; 114/305

[58] Field of Search ..... 114/295, 301, 304, 305; 285/7, 33, 303, 308, 317, 319

[56] References Cited

U.S. PATENT DOCUMENTS

| | | | |
|---|---|---|---|
| 699,273 | 5/1902 | Wolski . | |
| 1,002,501 | 9/1911 | Clark | 285/303 X |
| 1,086,053 | 2/1914 | Howell . | |
| 1,315,721 | 9/1919 | Hall | 114/295 X |
| 2,460,352 | 2/1949 | Jensen | 285/308 X |
| 2,583,965 | 1/1952 | Page et al. . | |
| 2,703,544 | 3/1955 | Ewing et al. . | |
| 2,982,244 | 5/1961 | Triechman . | |
| 2,999,572 | 9/1961 | Hinckley . | |
| 3,054,123 | 9/1962 | Moeller . | |
| 3,118,417 | 1/1964 | Stanwick . | |
| 3,187,705 | 6/1965 | Costello et al. . | |
| 3,207,115 | 9/1965 | Anderson . | |
| 3,212,110 | 10/1965 | Lombardo | 114/305 X |
| 3,215,454 | 11/1965 | Hayes | 285/317 |
| 3,291,092 | 12/1966 | Halberg et al. . | |
| 3,311,080 | 3/1967 | Anderson et al. . | |
| 3,621,805 | 11/1971 | Smith | 114/305 |
| 3,850,128 | 11/1974 | Lovell . | |
| 3,910,218 | 10/1975 | Taylor et al. | 114/295 |

FOREIGN PATENT DOCUMENTS

| | | | |
|---|---|---|---|
| 7512361 | 10/1975 | Netherlands | 114/295 |

*Primary Examiner*—Joseph J. Rolla

*Attorney, Agent, or Firm*—Fleit & Jacobson

[57] ABSTRACT

A permanent mooring for use with boats and the like is provided with folding flukes on a tubular body. The flukes are formed as portions of a cylinder and in their folded position completely envelope the mooring with a smooth cylindrical surface which decreases unwanted drag during installation. A connection is provided for attaching a high-pressure water pipe and the forward end of the mooring anchor is tapered so as to form a water jet nozzle. The mooring is directed to the bottom of the water and, upon pumping the water through the pipe and out of the nozzle, the mooring anchor is forced downwardly into the sand or mud by the washing action of the water, the weight of the mooring itself, as well as additional downward pressure on the water supply pipe by the installation personnel. Once the mooring is in place, as indicated by markings on the high-pressure water pipe, the pipe is removed from the mooring and the mooring is permanently fixed in the ocean bottom by applying upward tensional forces on a suitable mooring chain or line, which has been connected to the mooring anchor prior to installation. Another embodiment employs a nylon web or mesh between the flukes to increase the holding power of the permanent mooring in the sea bottom.

18 Claims, 9 Drawing Figures

PERMANENT MOORING APPARATUS

BACKGROUND OF THE INVENTION

The present invention relates to permanent mooring anchors and more, specifically relates to a permanent mooring anchor which may be embedded in the sea bottom then caused to be permanently retained therein by the interaction of foldable flukes with the sea bottom.

The sport of boating has become increasingly popular of late and for this reason the space available to moor the boats has also become increasingly scarce. Because there is not sufficient dockage to provide a slip for all of the boats, it has become the practice to moor boats in small bays, inlets, or the like, located adjacent to the dock areas of yacht clubs and marinas.

Commonly, in order to provide the numerous permanent moorings required for all of such boats at a yacht club or marina, large blocks of concrete with eyelets embedded therein are placed on the sea bottom. A line from each block of concrete is run to the surface of the water and a buoy attached, and boaters secure their boats to the buoy. Even with the use of a large block of concrete, it is still necessary to wait a certain period of time for the sea bottom to cover the concrete, so as to provide a permanent and secure mooring, such that a boat will not drag the concrete block across the sea bottom. Of course, in placing a large block of concrete, it is necessary to have a relatively large work boat and a boom and winch arrangement to load the concrete blocks onto the boat, to move them to the desired location, to lower the blocks overboard and to place them in the correct location. Typically, in the general mooring area the water is only from 12–35 feet deep.

BRIEF SUMMARY OF THE INVENTION

The present invention provides a permanent mooring, preferably formed of metal and having foldable flukes. The mooring is intended to be driven into the sea bottom by means of water pressure and by downward force applied to the water supply pipe. Upon attempting to retract the permanent mooring from the sea bottom, the flukes will unfold and grasp the sea bottom, thereby resisting attempts to withdraw the mooring.

A rigid pipe is connected to the permanent mooring apparatus and is then directed perpendicularly to the sea bottom by personnel located on the work boat. High-pressure water is then pumped through the pipe from the work boat. The jet action of the water, in combination with the weight of the mooring anchor itself and additional downward pressure on the supply pipe by the installer, forces the permanent mooring anchor into the sea bottom so that it is embedded in the sand, well beneath the bottom line. At this point in the installation, the flukes are folded up against the body of the mooring. The flukes are formed of curved cylindrical surfaces of rotation and completely surround the permanent mooring anchor when they are in the folded state. This presents only a small drag force when the permanent mooring anchor is embedded in the sand. In addition, a fairing or shield can be used to increase the ability of the permanent mooring to penetrate the bottom. The folded flukes are held in place by a plastic band or strap which may be released from the surface. When the permanent mooring is in place, the plastic band is broken, and internal springs will force the flukes outwardly. At this point in the installation the entire assembly is moved up and down so that the flukes will be fully opened. The water-supply pipe is then disconnected from the body of the mooring and retrieved on board the work boat at the surface. A yoke assembly or the like is provided on the mooring anchor to which is attached a chain or mooring line before embedding the assembly in the sea bottom and, upon applying tensional force on the mooring line, the flukes will unfold further and dig into the sea bottom, which has totally covered them. The interaction between the flukes and the sea bottom will provide sufficient drag to prevent the mooring from being removed from the sea bottom. A buoy is then affixed to the end of the mooring line at the surface and the mooring is operational.

The permanent mooring apparatus may be provided with any number of foldable flukes, from two to twelve, and may be of various sizes, ranging from 18′ in length to upwards of 4′ in length, depending upon the size of the craft to be moored. The permanent mooring is intended to be constructed of any corrosion-resistant material, such as galvanized steel, anodized aluminum, or any metal coated with epoxy paint or, alternatively, of a synthetic non-metallic material, such as ABS or PVC plastic.

The initial placement depth of the permanent mooring into the sea bottom may be associated by marks located on the portion of the water-supply pipe, which is above the water surface. By monitoring the progress of the permanent mooring down into the sea bottom, it may be determined when the permanent mooring has been embedded to such an extent that the flukes are well beneath the sea bottom.

The inventive permanent mooring is designed to be made using standard pipe fittings which are readily available, so as to provide easy construction and to keep the unit costs at a low level.

Therefore, it is an object of the present invention to provide a permanent mooring which may be embedded in the sea bottom by means of water pressure from a jet at a nozzle end which, washes sand and debris from the sea bottom and by means of downward force applied on the water supply pipe from the surface.

It is another object of the present invention to provide a permanent mooring having foldable flukes which, when unfolded, resist withdrawal of the embedded mooring from the sea bottom.

It is another object of the present invention to provide a permanent mooring having foldable flukes which are formed so that when the flukes are folded they completely surround the permanent mooring and provide a smooth outer shell.

It is still another object of the present invention to provide a permanent mooring which may be embedded in the sea bottom by means of a water pressure jet.

It is still a further object of the present invention to provide a permanent mooring which may be embedded having foldable flukes connected by a netting whereby, upon embedding the mooring into the sea bottom, the flukes and netting unfold in umbrella fashion and resist attempts to withdraw the mooring from the sea bottom.

The manner in which these and other objects are accomplished by the present invention will be made clear from the following detailed description of an embodiment of the invention.

DETAILED DESCRIPTION OF THE PREFERRED EMBODIMENT

Figure 1:
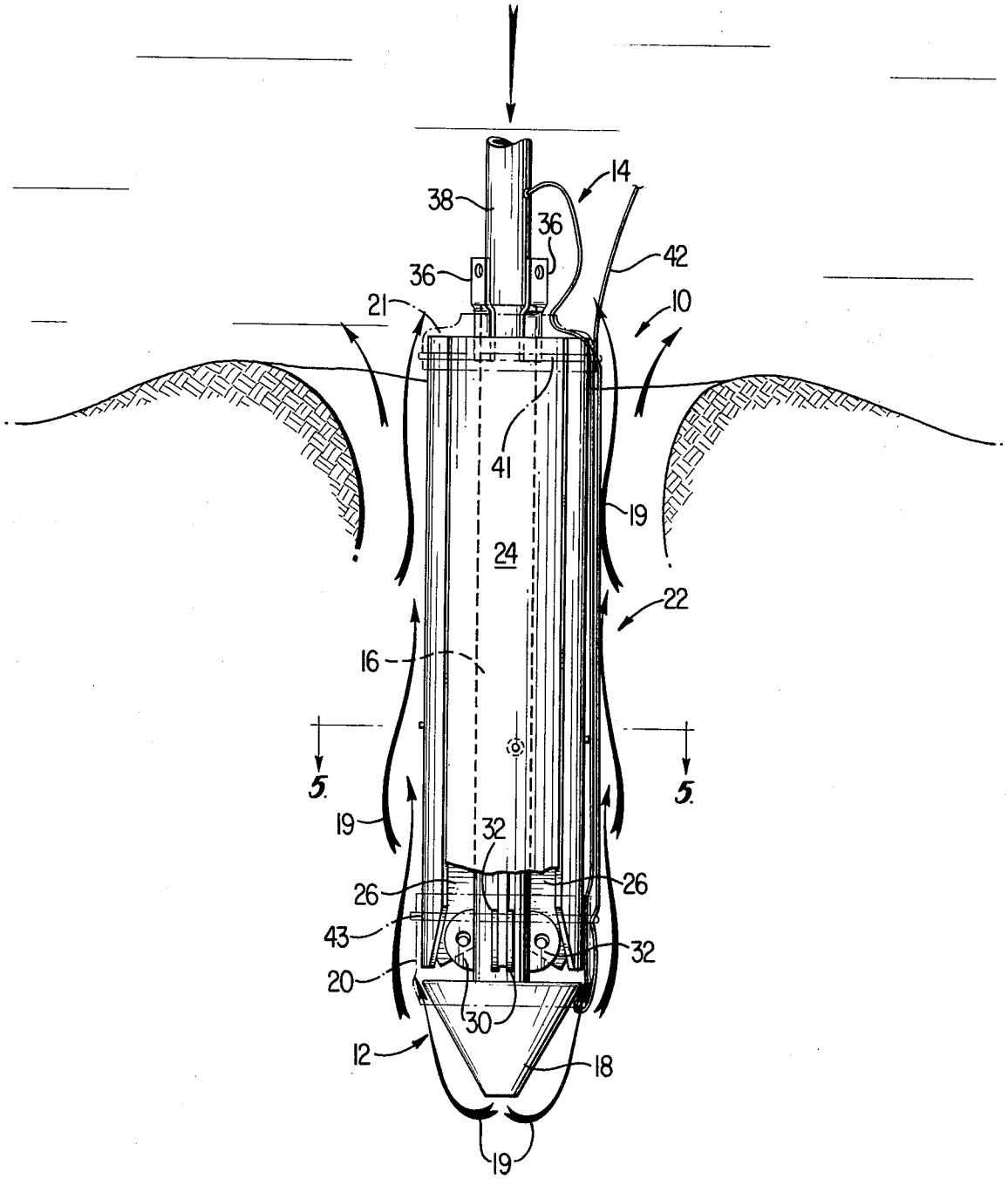
FIG. 1 is a side elevation of the inventive permanent mooring with flukes in a folded position.

Referring now to FIG. 1, the inventive mooring apparatus is shown at 10 having a tip or nozzle portion 12 for embedding into the sea bottom and a high pressure water inlet system 14 for connection to a high-pressure water supply. The mooring anchor comprises a tubular body portion 16 and a tapered nozzle portion 18 which may be hardened for forcing into the sea bottom. It may also be provided in the tip or nozzle portion 12 with a screen, or rods, or the like to prevent debris from entering into the tip or nozzle portion prior to actuation of the high-pressure water source. The arrows, shown generally at 19, indicate the direction the high-pressure water jet would take once penetration commences. This water flow will remove debris on the bottom of the body of water and, thereby, act as a lubricant to aid in the penetration of the mooring apparatus into the bottom substance. As an additional aid in penetrating the sea bottom, removable or rupturable fairings or shields, may be provided to shroud the hinge plate assemblies and the top of the flukes to further reduce drag. The lower fairing is shown at 20, and the upper fairing is shown at 21.

The foldable flukes are shown typically at 22, and the present embodiment employs four such flukes. A typical fluke consists of a concave blade-like portion 24 and a main arm or body portion 26. The concave blade 24 is a portion of a cylinder and, when the blades are folded up, they form a cylindrical shell around the mooring to aid in penetrating the sea bottom. Each fluke is attached to the main body 16 by two parallel mounting plates 30 and 32. The main arm or body portion 26 of each fluke is arranged between its respective mounting plates 30 and 32 and is pivotally held there by means of a pin or axle 34 (FIG. 6), it being understood, of course, that each fluke is mounted identically. At the top end of the main tube 16 are three shackle bars 36 to which will be attached the mooring line or chain. The shackle bars 36 may be welded to the main tube 16. Additionally, the fluke mounting plates, 30 and 32, are also welded to the main tube 16 of the permanent mooring.

Figure 4:
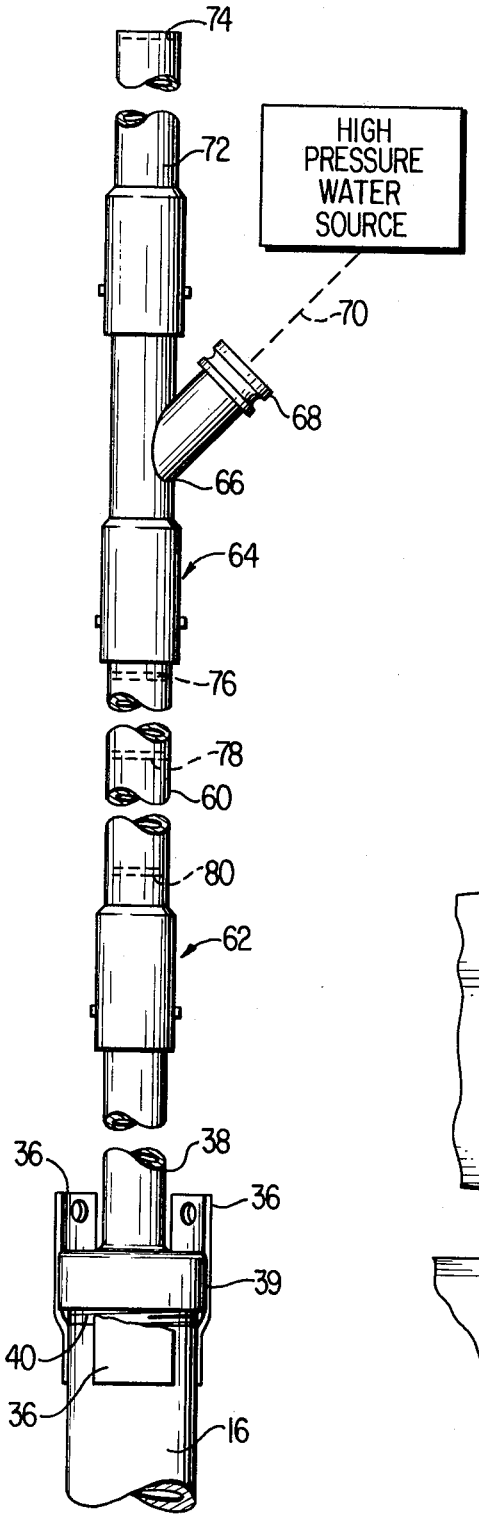
FIG. 4 is a side elevation, partially schematic, showing the supply pipe of the present invention.

The high-pressure water inlet system 14 consists of lengths of supply pipe 38 threadedly engaged or coupled together in the manner of vacuum-cleaner extension tubes. The pipe 38 can then be welded to a nipple or flange 39 which is threadably engaged with the supply pipe 38 at 40 (FIG. 4). However, the water supply pipe 38 is not to be threaded to the main body if it is to be released by pulling on a leader that disengages with the supply pipe 36 in a vacuum cleaner-type hook-up (as will be explained in more detail below). The flukes 22 are provided with spring-actuated plungers, which cannot be seen in FIG. 1 and the flukes are retained in the folded position, with the plunger springs loaded, by a plastic band or strap 41. This plastic band 41 also serves to retain the disposable plastic fairing 21, which prevents dirt and debris from entering the mooring device. The band 41 and fairing 21 are formed having a thin wire, such as a fishing leader 42, running beneath them, i.e., next to the flukes 22, in such a way that, upon pulling the wire 42 on the surface, the fairing 21 will be split and the band 41 will part, thereby releasing the flukes 22. This operation may be likened to the opening of a packet of cigarettes.

When employing a lower fairing 20, to protect the fluke hinge assembly and to increase the ease with which the permanent mooring can be inserted into the sea bottom, the wire leader 42 can be run down the outside of the mooring and under the lower fairing 20 and another plastic band 43, which aids in retaining the fairing 20 and the flukes in position. The lower band 43 and lower fairing 20 are released in the same manner as the upper fairing 21 and band 41, i.e., by pulling on wire 42 from the surface. FIG. 1 shows both upper and lower fairings, 21 and 20, in place with their respective plastic bands, 41 and 43. Wire leader 42 is in the proper position to be pulled from the surface to release both hands, 43 and 41.

Figure 2:
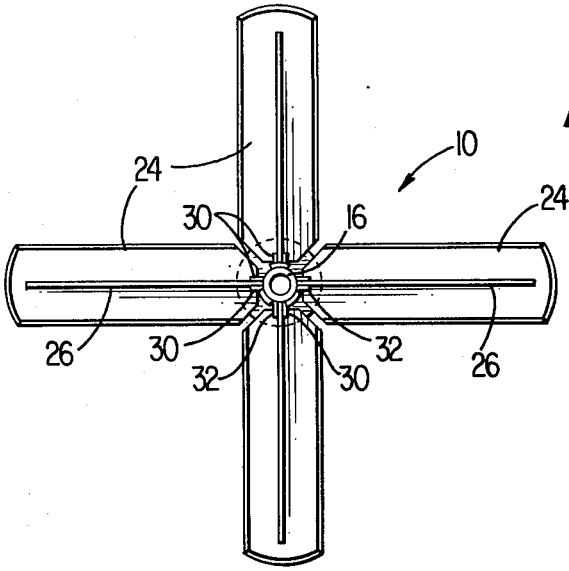
FIG. 2 is a top plan view of the inventive permanent mooring with the flukes unfolded.

FIG. 2 shows the mooring anchor in a top plan view, and supply pipe 38 and nipple 39 may be seen, as well as the shackle bars 36. In this embodiment, the pipe 38 is welded to the flange 39, which is screwed onto the top of the main body tube 16 at 40, in essentially a sealing-type engagement. As will be seen hereinbelow, the pipe 38 and flange 39 are intended for a relatively quick release from engagement with the permanent mooring 10. A thread having an exceptionally quick release, i.e., a coarse thread, such as those used in well drilling or those used in making soil percolation tests, is desirable.

The inventive permanent mooring is intended to be formed of any corrosion-resistant metal, such as stainless steel, or, alternatively, of galvanized or zinc-coated steel. In this regard, it is noted that galvanized steel has a tendency to corrode less when it is completely immersed in water than when it is continuously wetted and dried, as in the air. Additionally, because the actual weight of the permanent mooring is not a factor in its embedding into the sea bottom, the permanent mooring may also be formed wholly or partially of plastic or synthetic material, provided that sufficient strength is provided in the flukes.

Figure 3:
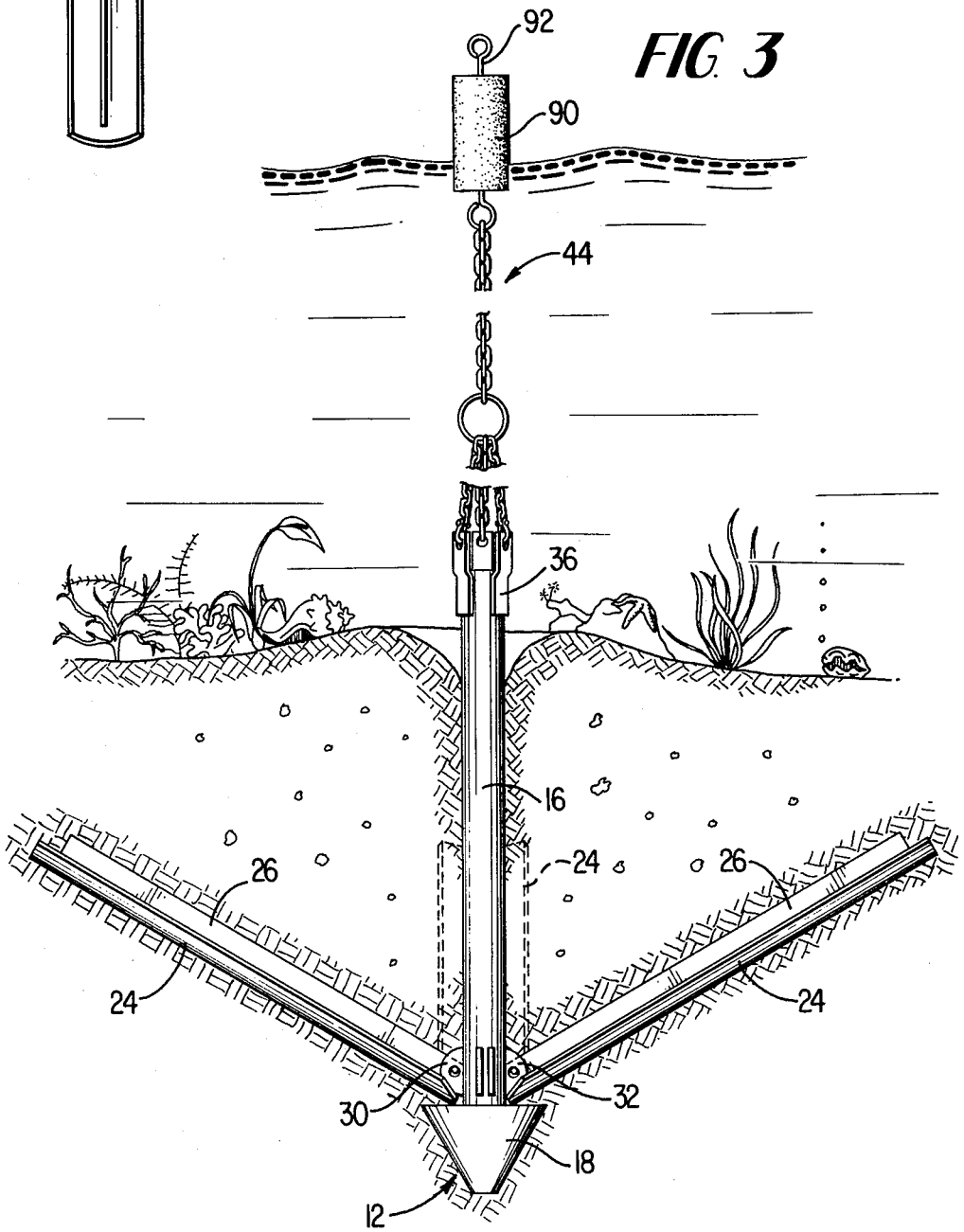
FIG. 3 is a side elevation in diagrammatic form of the inventive mooring placed in the sea bottom.

Turning now to FIGS. 1 and 3, the operation of the inventive permanent mooring will be described. In operation, the mooring is pointed towards the sea bottom from the work boat by the installation personnel grasping the uppermost portion of pipe 38. Upon contacting the sea bottom with the nozzle 12, the high-pressure water is fed through tube 38, down through the hollow body 16, and out the nozzle assembly 12, as indicated by arrows 20, while the operator is exerting a downward force on the pipe 38. The operator at the surface in the work boat can determine when the permanent mooring has been embedded sufficiently into the sea bottom by monitoring the markings located on the water-feed pipe 38. The wire 42 can then be pulled so as to release the bands 41 and permit the spring-loaded plungers to force the flukes 22 into an initial open position. Pulling on the mooring chain 44 attached to shackle bars 36 will further set the flukes in the sea bottom.

Referring to FIG. 4, the feed pipe 38 is connected to an extension portion 60 by means of a push-to-release vacuum-cleaner type connection 62. Connected to extension 60 by push-to-release connection 64 is a Y-shaped fitting 66, having an inlet 68 to which is connected the high-pressure water-feed hose, shown schematically by dashed line 70. Connected to fitting 66 may be one or more additional pipe sections 72, however, the last section must be sealed at its end by a plug 74.

The water-supply pipe can be galvanized pipe and should be of the same diameter as the main mooring body. The pipe can be in lengths of from six to ten feet to facilitate handling, depending upon the depth of the water.

The Y-shaped fitting 66 may be a shorter length, such as eighteen inches. The connection for the water hose is the conventional suction/discharge type of fitting. By permitting the fitting 66 to be connected at any location in the pipe assembly, the handling of the assembly is made easier, since it would be very heavy if the water hose were connected at the top of the assembly. Nevertheless, the water-supply assembly can be set up so that the Y-shaped fitting 66 can be inserted in the line at whatever point is required by a particular application.

On extension 60 may be seen markings 76, 78 and 80. By monitoring the location of these markings relative to the water surface at the beginning of the installation operation and having the markings identified so as to indicate the necessary depth to which the permanent mooring must be embedded, it is an easy task for the installer to determine when the permanent mooring has been embedded into the sea bottom a sufficient amount.

FIG. 3 shows the inventive permanent mooring already embedded in the sea bottom with the flukes deployed. As indicated above, the permanent mooring is lowered downward by means of the tubing 38 until it is nearly adjacent the sea bottom, whereupon a downward force is placed on the supply tube, and the high-pressure water is fed into the supply tube 38 and out of the nozzle assembly 12. In this manner, the permanent mooring is caused to embed itself into the sandy or muddy bottom by means of downward pressure on the supply tube 14 and the washing action of the high-pressure water, which is being expelled from the nozzle 12. The water forces the sand, mud, silt and the like up and back over the surface of tubular body portion 16, as shown by arrows 19 in FIG. 1, thereby acting as a lubricant during the embedding process.

After embedding the permanent mooring 10 into the sea bottom, as shown in FIG. 3, the retaining bands, 41 and 43 (FIG. 1) are broken and fairings 20 and 21 are removed by pulling on line 42, and the high-pressure supply pipe 38 is removed, leaving only the anchor chain or line 44 attached to a ring 82 and three, sixteen-inch lengths of chain 84 which are attached to the shackle bars 36. The line 44 may then be connected to a buoy 90 on the water surface. The buoy 90 then provides the requisite interface 92 for attaching the boat to the mooring. It is understood that the flukes 22 are folded upwards, as in FIG. 1, during the embedding process and, after embedding the permanent mooring into the sea bottom by the requisite amount, as indicated by the markings 76, 78, 80 on the pipe 60 and releasing the retaining bands 41 and 43, an upward pull on line 44 will cause interaction between the sea bottom and the flukes 22, which will become completely unfolded, as shown in FIG. 3.

Figure 5:
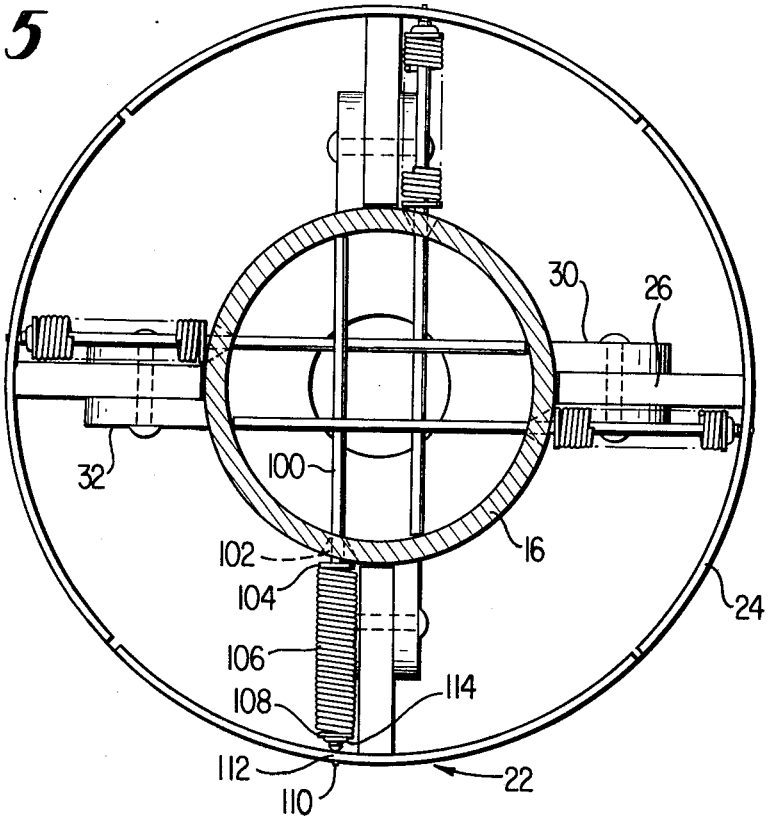
FIG. 5 is a cross-sectional view taken along line 5—5 of FIG. 1.

FIG. 5 is a cross-sectional view of the permanent mooring apparatus of FIG. 1, taken along sight line 5—5. In FIG. 5 the plunger and spring assembly which initially forces the flukes outwardly is shown in greater detail. Specifically, each fluke 22 is provided with a plunger rod 100, which extends through a hole at 102 into the interior of the tubular main body 16. The plunger assembly comprises the rod 100, a washer 104 located outside of the main tube 16, a compression spring 106, and a second retaining washer 108. The end of the rod 100 is tapered to a point 110 and is inserted into a hole at 112, formed in the fluke blade 24. The second retaining washer 108 is prevented from sliding off the end of rod 100 by swaging it or welding it to the rod 100 at 114. The hole at 102 which is formed in the main body tube 16 is formed with its sides sloping or fanning outwardly, in order to permit the plunger 100 to slant downwardly when it is extended out of the main body tube 16. Each fluke is provided with its own individual plunger and spring assembly, and each assembly is located at a different level along the main body in order to prevent interference among the rods 100, which are inside of the main body tube 16.

Prior to the embedding operation, the plunger and spring assemblies are inserted into the main tube 16 and the fluke blades 24 and springs 106 are compressed. When all of the flukes 22 have been forced inwardly so as to compress the springs 106, the fairings, 20 and 21, and the retaining bands, 41 and 43, are placed around the flukes to prevent them from being forced outwardly and to keep the springs 106 in a loaded condition. The wire leader 42 is arranged beneath the fairings and bands.

Alternatively, or in combination with the plunger assembly, water nozzles could be drilled inside the main pipe and connected to the main water supply so as to form a water jet to force open the flukes.

Figure 6:
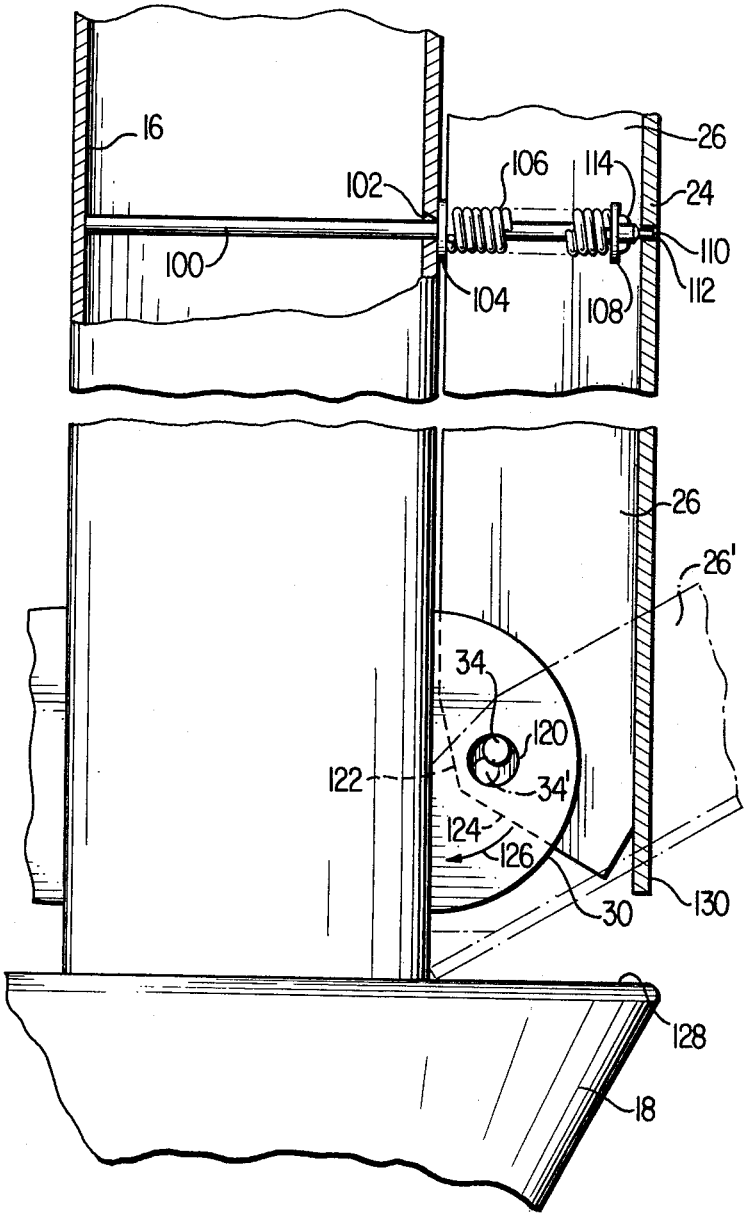
FIG. 6 is a detail side elevation of a fluke hinge and plunger assembly of the inventive permanent mooring.

FIG. 6 shows the manner in which the flukes 22 are pivotally attached to the main body 16 of the permanent mooring. The fluke arm 26 has a pivot pin or axle 34 which is located in a hole 120 in the mounting plates 30, 32. The hole 120 may be round as shown or it may be elongated, elliptical or any other shape, so long as sufficient clearance is provided to permit pin 34 to travel in an elliptical path. When the fluke 22 is in its retained position, as shown in FIG. 1, the pin 34 is toward the top of the hole 120 and the lower surfaces of arm 26 are not abutting the main tube 16. In this regard, the lower portion arm 26 is formed having angled sides 122 and 124, shown in dashed lines since they are hidden by mounting plate 30. Angled surface 122 is necessary to permit the arm 26 to swing outwardly without interfering with the main tube 16 and surface 124 is provided to abut the main tube 16 and to restrict thereby the pivotal motion of arm 26. The extent of pivotal motion of the arm may be seen from the dot-and-dash lines which show the fluke in its unfolded position. The arrow 126 shows the travel made by angled surface 124. As a further means of limiting the extent of opening of the flukes, the nozzle 12 is dimensioned so that its top surface 128 can abut the bottom part 130 of the flukes 22. The top surface 128 of the nozzle 18 cooperates with the lowermost portion 130 of the fluke and surface 124 of the fluke arm 26 cooperates with the main tube to rigidly secure the fluke arm 26 in its unfolded position. Each fluke 22 is attached in the same way and operates identically.

Figure 7:
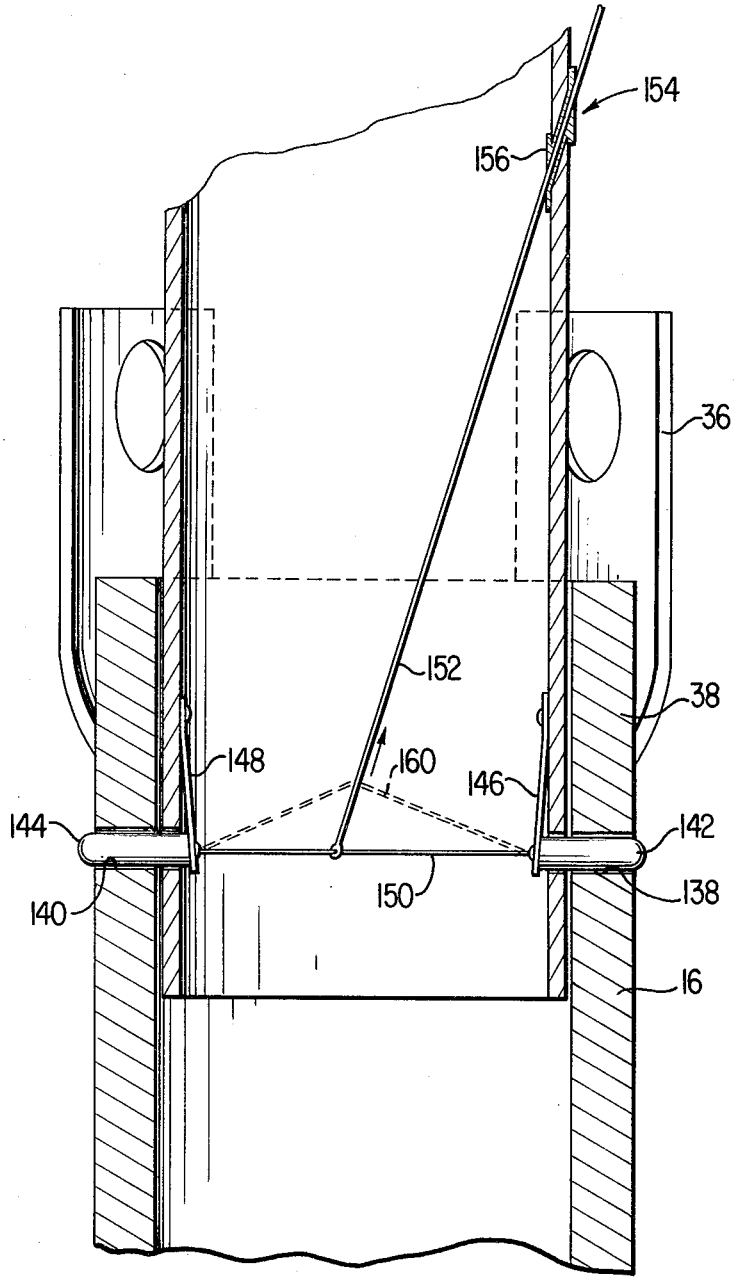
FIG. 7 is a cross-section view showing a manner of connecting the supply pipe to the inventive permanent mooring.

FIG. 7 shows an arrangement for connecting and disconnecting the water supply pipe to the main tube of the permanent mooring. This embodiment employs the same vacuum-cleaner type of quick-release connections, as described in connection with FIG. 4, except that the connection of FIG. 7 is remotely releasable. More specifically, the water supply tube 38 has an outside diameter which is slightly less than the inside diameter of the main tube 16. Two apertures 138 and 140 are formed in the main tube 16, which are intended to accept two pins 142, 144, respectively. These pins 142, 144 are attached to the inside of the supply pipe 38 by two flat springs 146, 148, respectively. The flat springs 146, 148 bias the pins 142, 144, in an outward direction, which keeps the supply tube 38 and the main tube 16 connected. Stretched between, and attached to, the two pins 142, 144 is a flexible cable 150. Firmly affixed at the approximate midpoint of the cable 150 is a flexible woven-wire leader 152 which extends upwards and through an aperture 154 in the supply tube 38. A grommet or seal 156 is provided at aperture 154 so that there is no loss of water pressure at the point were the leader 152 exits through the aperture 154. Leader 152 corresponds to wire leader 42 in FIG. 1 and is also used to release the retaining bands and the streamline fairings. This will be shown in more detail in FIG. 8. The leader 152 is then connected to a standard nylon rope (not shown) which runs to the surface of the water and is available onboard the work boat.

Figure 8:
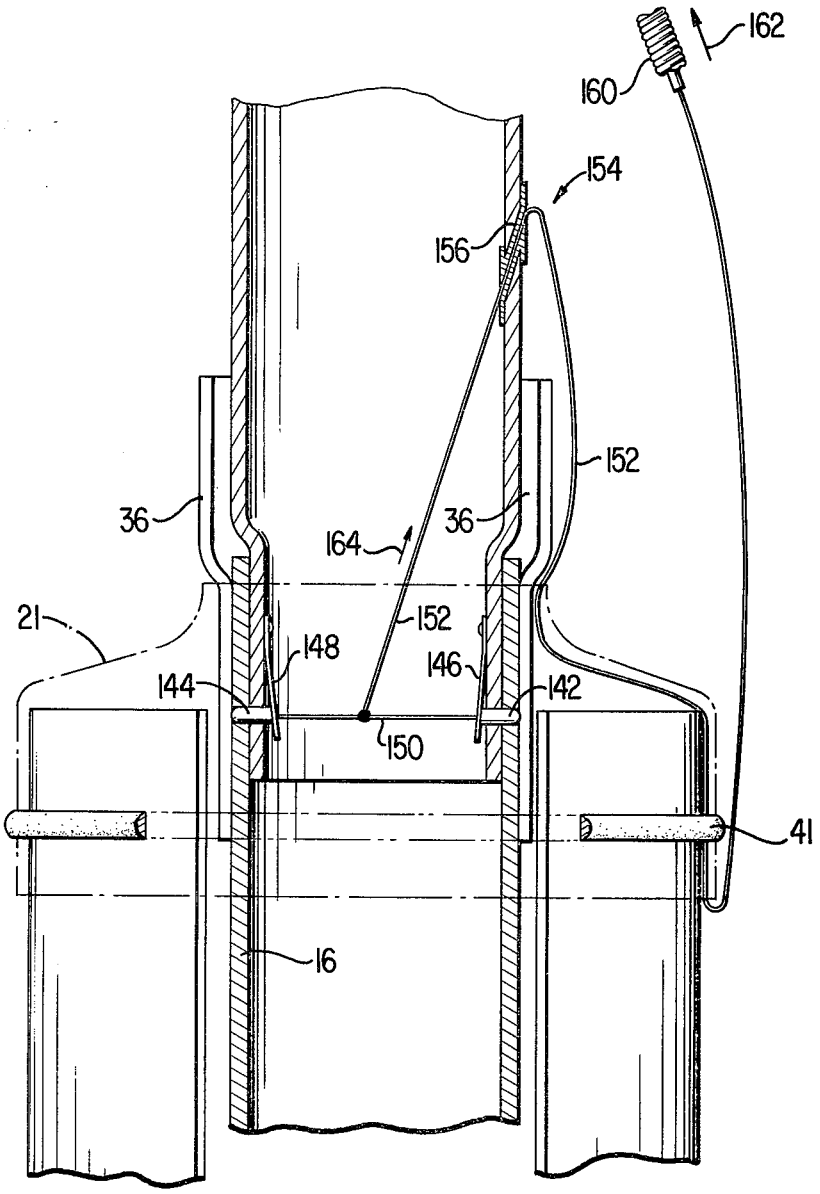
FIG. 8 is a cross-section view showing a manner of removing a protective shield and retaining band when releasing the supply pipe.

FIG. 8 shows the upper portion of the permanent mooring having a top fairing 21 arranged therearound and the flukes 22 being retained by plastic band 41. The flexible wire leader 152, which serves to sever the fairing 21 and band 41, is arranged between the fairing 21, the band 41, and the main tube 16 and flukes 22. It is understood that wire leader 152 can also be run down the body of the mooring device and used to sever and release the lower fairing 20 and band 43 of FIG. 1.

The quick-release assembly of FIG. 8 is operated as follows. After the supply tube 38 and main tube 16 have been connected at the surface and the permanent mooring has been embedded in the sea bottom, the rope 160, which is attached to the leader 152, is pulled in the direction of arrow 162. The thin wire 152 will slice through the fairing 21 and part the retaining band 41. The spring assemblies will then force the flukes outwardly and they can engage the sea bottom. The rope 160 is continued to be pulled from the surface. This will cause the flexible cable 150 to move in the direction of the arrow 164 to a position shown approximately by the dotted lines at 166. In this position the pins 142, 144 will be retracted from their engagement position, shown in FIG. 7, and the two pipes, 16 and 38, can be uncoupled by pulling on the pipe connected to supply pipe 38.

Figure 9:
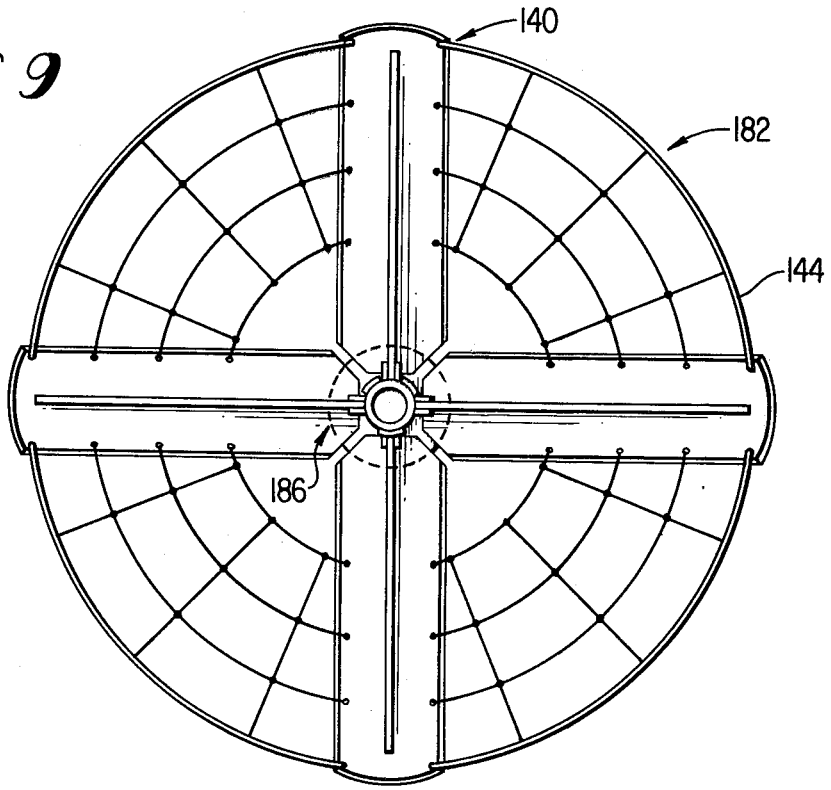
FIG. 9 is a top plan view of another embodiment of the present invention.

Referring now to FIG. 9, an alternate embodiment of the present inventive permanent mooring is shown. Specifically, the flukes, shown typically at 180, have attached therebetween a strong mesh, net, or webbing 182. The webbing may be formed of nylon, Kevlar, or any other substantially indestructable synthetic material. The radially outermost element 184 of the mesh 182 should be formed having an increased diameter, or could be formed of a woven steel cable, in order to withstand the increased forces imparted thereto during opening of the flukes. The arrangement for hingedly attaching the flukes to the body 16 of the permanent mooring, shown typically at 186, is essentially the same as in the embodiment of FIG. 1. Because in this embodiment the flukes 180 are also formed of curved plates which completely surround the permanent mooring during installations when the flukes are in the stored or ready position prior to embedding into the sea bottom, the net 182 can be stored and arranged behind the fluke plates. In this way, no unnecessary drag will be provided by the mesh during the embedding process.

Once the embodiment of FIG. 9 has been embedded into the sea bottom, an operation similar to the operation of FIG. 8 takes place. The wire leader is pulled, the retaining band or bands are removed and an upward pull on the anchor line will cause the flukes to interact with the sea bottom, thereby deploying them outwardly to their fullest extent, and the mesh 182 will increase the drag against the sea bottom. This will provide a permanent mooring for a larger type vessel, i.e., one which will withstand more upward pressure.

It is understood, of course, that the foregoing description of the present invention is provided by way of example only and is not intended to limit the scope of the present invention, except as set forth in the appended claims.

I claim:

1. A permanent mooring for embedding in a sea bottom, comprising:

a hollow tubular body having a top end and a bottom end, a plurality of flukes foldably attached to said body and arranged to pivot outwardly from a first position in relation to said body, said plurality of flukes cooperating with one another in the first position to substantially surround said hollow tubular body and to form a substantially closed cylindrical surface, nozzle means arranged at said bottom end of said body for washing said mooring into the sea bottom, transmitting means affixed to said body for transmitting a tensional force, release means releasably holding the plurality of flukes in the first position and responsive to said tensional force from said transmitting means for releasing the plurality of flukes from said first position, and connection means connecting a high-pressure fluid source to said hollow tubular body for receiving said fluid and transmitting said fluid, via said hollow tubular body, under high pressure to said nozzle means;

wherein, upon placement of said mooring in the sea bottom, said high-pressure fluid source provides fluid under high pressure to said hollow tubular body, said hollow tubular body transmits said fluid to said nozzle means, and said nozzle means expels said fluid under high pressure so as to facilitate embedding of said permanent mooring in the sea bottom; and wherein, upon application of said tensional force to said permanent mooring, said transmitting means transmits said tensional force to said release means so as to release said plurality of flukes from said first position and permit said plurality of flukes to pivot outwardly;

said permanent mooring further comprising stop means associated with said plurality of flukes for preventing said plurality of flukes from pivoting outwardly more than a predetermined distance.

2. The mooring of claim 1 wherein each of said plurality of flukes comprises a main arm portion having a blade formed of a concave inwardly facing cylindrical surface attached to the full length of the arm and having one end of said arm attached to said stop means.

3. The mooring of claim 1 further comprising web means disposed betweeen adjacent ones of said plurality of flukes and being fixedly attached thereto.

4. The mooring of claim 1 wherein said connection means comprises a pipe provided with markings at an end thereof connected to said high-pressure fluid source, said markings being positioned on said pipe in a predetermined relationship to the length of said hollow tubular body.

5. The mooring of claim 1 wherein said release means comprises a releasable band surrounding said plurality of flukes and retaining said flukes in a folded position, said mooring further comprising bias means arranged between said hollow tubular body and said plurality of flukes for biassing said flukes in an outward direction in relation to the longitudinal axis of said hollow tubular body, said transmitting means comprising a wire attached to said band and continuing to the sea surface, wherein, upon applying a tensional force to said wire, said band is release and said bias means causes said plurality of flukes to move in said outward direction.

6. The mooring of claim 1 wherein said connection means comprises a pipe including a plurality of pipe segments, each joined one to another by quick release joints.

7. The mooring of claim 1 wherein said connection means comprises a pipe connected to said hollow tubular body by means of a quick release joint, said transmitting means being attached to said quick release joint so that, upon exertion of a tensional force on said transmitting means, said pipe is released from said hollow tubular body.

8. A permanent mooring of the type for embedding into the sea bottom using a source of fluid pressure connected to a rigid pipe, comprising:

a tubular body member having a nozzle arranged at one end for expelling fluid, connecting means for connecting said rigid pipe to said tubular body member for forcing said fluid under high pressure through said tubular body member and out said nozzle, a plurality of flukes hingedly attached to an exterior surface of said tubular body member and arranged to pivot outwardly from a first position in relation to said hollow tubular body to a second position, said plurality of flukes cooperating with one another in the first position to substantially surround said hollow tubular body and to form a substantially closed cylindrical surface, means for limiting the extent of motion of said plurality of hingedly attached flukes such that said flukes can be in said first position folded substantially parallel to the longitudinal axis of said tubular body member and in said second position unfolded substantially perpendicular to the longitudinal axis of said tubular body member, and transmitting means attached to said tubular body member and extending therefrom to the surface of the sea for transmitting tensional force, and release means releasably holding the plurality of flukes in said first position and responsive to said tensional force from said transmitting means for releasing the plurality of flukes from said first position;

wherein, upon location of said mooring adjacent the sea bottom, said fluid is expelled from said nozzle, whereupon said mooring is embedded in the sea bottom, and, upon application of said tensional force to said transmitting means, said transmitting means transmits said tensional force to said release means and said release means releases the plurality of flukes from said first position and the plurality of flukes are moved to said second position.

9. The mooring of claim 8 wherein each of said plurality of flukes comprises a main arm portion pivotally attached to said tubular body at one end and having an inwardly facing cylindrical surface forming a blade affixed along the length of said arm.

10. The mooring of claim 8 further comprising spring means cooperating with said tubular body for forcing said plurality of flukes toward said second position, wherein, upon application of said tensional force to said transmitting means, said release means releases said plurality of flukes and said spring means forces said plurality of flukes toward said second position.

11. The mooring of claim 8 wherein said rigid pipe comprises a plurality of pipe segments, each joined one to another by quick release joints.

12. The mooring of claim 8 wherein said rigid pipe is connected to said tubular body by means of a quick release joint, and said transmitting means is attached to said quick release joint, and wherein, upon exertion of a tensional force on said transmitting means, said rigid pipe is released from said body.

13. The mooring of claim 8 wherein said plurality of flukes are equally spaced around a circumference of said tubular body member and further comprising webbing means attached between adjacent flukes.

14. The mooring of claim 13 wherein said tubular body member is formed with longitudinal channels equal in number to the number of said plurality of flukes for storing said webbing means when said flukes are in said first position.

15. The mooring of claim 14 wherein said plurality of flukes comprises four flukes.

16. The moorin of claim 15 wherein said mooring is formed of galvanized steel.

17. A permanent mooring for embedding in a sea bottom, comprising:

a hollow tubular body having a top end and a bottom end, a plurality of flukes foldably attached to said body and arranged to pivot outwardly from a first position in relation to said body, said plurality of flukes cooperating with one another to substantially surround said hollow tubular body and to form a substantially closed cylindrical surface, release means releasably holding the plurality of flukes in the first position and capable of being operated by a tensional force, nozzle means arranged at said bottom end of said body for washing said mooring into the sea bottom, transmitting means associated with said release means for transmitting a tensional force to said release means to operate same and release the plurality of flukes from the first position and permit said plurality of flukes to pivot outwardly, and connection means at the top end of the hollow tubular body for receiving a pipe connected to a high-pressure fluid source for receiving and transmitting said fluid under high pressure to said nozzle means;

wherein, upon placement of said mooring in the sea bottom, said high-pressure fluid source provides fluid under high pressure, via said pipe, to said connection means and thereby transmits said fluid to said nozzle means, whereupon said nozzle means expels said fluid under pressure to facilitate embedding of said permanent mooring in the sea bottom; and wherein, upon application of said tensional force to said transmitting means, said transmitting means transmits said tensional force to said release means to release said plurality of flukes from said first position and permit said plurality of flukes to pivot outwardly; and said permanent mooring further comprising stop means associated with said plurality of flukes for preventing said plurallity of flukes from pivoting outwardly more than a predetermined distance.

18. The mooring of claim 17, wherein said hollow tubular body defines attaching means for enabling a buoy and anchor rode to be attached to the permanent mooring, whereby the permanent mooring may be located after embedding in the sea bottom.

* * * * *